United States Patent [19]

Kato et al.

[11] Patent Number: 4,475,501

[45] Date of Patent: Oct. 9, 1984

[54] ELECTRONIC CONTROL TYPE FUEL INJECTION SYSTEM

[75] Inventors: Katsushi Kato; Shigenori Isomura; Akio Kobayashi; Toshio Kondo, all of Kariya, Japan

[73] Assignee: Nippondenso Co., Ltd., Kariya, Japan

[21] Appl. No.: 348,178

[22] Filed: Feb. 12, 1982

[30] Foreign Application Priority Data

Feb. 16, 1981 [JP] Japan ..... 56-21264

[51] Int. Cl.[3] ..... F02D 5/02

[52] U.S. Cl. ..... 123/325; 123/493

[58] Field of Search ..... 123/325, 492, 493, 326

[56] References Cited

U.S. PATENT DOCUMENTS 4,221,193 9/1980 Ezoe et al. ..... 123/493
4,227,490 10/1980 Kobayashi et al. ..... 123/492
4,250,853 2/1981 Harada et al. ..... 123/326
4,311,123 1/1982 Glockler et al. ..... 123/325
4,327,682 5/1982 Harada ..... 123/326
4,357,923 11/1982 Hideg ..... 123/492

*Primary Examiner*—Tony M. Argenbright
*Attorney, Agent, or Firm*—Cushman, Darby & Cushman

[57] ABSTRACT

An electronic control type fuel injection system in which, at the time of engine deceleration the fuel injection is stopped, and when resuming to a normal fuel injection from the fuel injection stopped condition, if the reducing rate of the engine speed is smaller than a preset value, a smaller amount of fuel than the amount of fuel injection during normal operation as if fuel injection had not been stopped is first injected and subsequently the amount of fuel to be injected is gradually increased, while when the reducing rate of the engine speed is larger than the preset value, a larger amount of fuel than the fuel injection amount during normal operation is injected.

4 Claims, 6 Drawing Figures

ELECTRONIC CONTROL TYPE FUEL INJECTION SYSTEM

BACKGROUND OF THE INVENTION

This invention relates to an electronic control type fuel injection system which stops fuel injection when decelerating an engine, and particularly to the improvement of fuel injection in the resumption of the fuel injection from stopping of fuel injection to normal state thereof.

In the conventional fuel injection apparatus, a throttle sensor is provided in the throttle valve of engine to detect whether the opening degree of the throttle valve is less than a predetermined value or not. If the opening degree is less than the predetermined value (when the idle switch is in the on-state) and the engine speed is higher than a preset value $N_1$, fuel injection to engine is stopped, and then when the throttle valve is opened to a preset opening degree or above (the idle switch is in the off-state) or when the throttle valve is opened to less than the preset opening degree (the idle switch is in the on-state) and the engine speed is reduced to the preset rotational rate $N_1$ or below, resumption of fuel injection to supply the fuel again from the fuel stopped state is carried out.

As the method of resuming fuel supply when the engine speed is reduced to $N_1$ or below under the on-condition of the idle switch, there are two ways as follows:

(i) The pulse width is determined by the normal calculation; and (ii) As is known in the Japanese Laid-Open Publication No. 54-55237 published in 1979 and based on an application the priority of which is claimed in U.S. Pat. No. 4,221,193, a pulse for fuel supply whose pulse width is reduced to be narrower than that determined by the normal calculation first in the fuel injection resumption and then the value of reduction is gradually decreased in the laspe of time until the normal value is reached as it is called the reduction control at the time of fuel injection resumption.

The method (i) has the following drawbacks. Since the normal amount of fuel is injected immediately after cancellation of fuel injection stop, fuel combustion is started suddenly, therefore, the engine torque is increased rapidly, thus it makes the drive feeling poor. This phenomenon has a great effect on the feeling when the rotational rate of engine is low, and therefore the fuel supply cut rotational rate $N_1$ must be set up to be high for preventing from that the drive feeling becomes deteriorated. This setting of the rotational rate $N_1$ reduces the effects of such great advantages as low fuel consumption effect, low discharge of harmful exhaust gas, and low heat load of catalizer. In the method (ii) which is made in view of the problem of the drawbacks of the method (i), although the drive feeling during the normal decelerating running in the clutch-on state is improved, following drawbacks may occur, that is, when the rate of change of the engine speed is great as in the racing time (that is, when engine is driven while clutch is off), and when fuel amount reduction at resumption after cancellation of fuel injection stop is performed upon rapid decrease of engine speed, much time is required until the normal air-fuel ratio is restored to and insufficient combustion continues until the restoration of the ratio so that enough torque is not obtained, resulting in great reduction of the engine speed, in which case the reduced engine speed may not be able to be restored to the original value even if the normal air-fuel ratio is reached, and an engine stall is liable to occur. Therefore, the upon-fuel-cut speed $N_1$ is required to be inevitably increased like in the method (i) and thus has the same defect as in the method (i).

SUMMARY OF THE INVENTION

It is an object of this invention to provide an electronic control type fuel injection apparatus capable of preventing the engine stall at the fuel supply resumption and the deterioration of drive feeling, with the above problems solved.

This invention is made in view of the fact that the decelerating speed indicative of the rate of change of the rotational speed of engine is very great in the racing time (also in the case where clutch is turned off in the course of the normal decelerating drive), as compared with the normal decelerating speed with clutchon. And in this invention, the decelerating speed of engine is detected when the engine speed has reached the fuel-cut speed $N_1$, and if the decelerating speed is equal to a preset value or greater than the above, the condition is determined to be racing. At this time, simultaneously with fuel supply resumption a wider pulse width is applied to prevent engine stall. If the decelerating speed is lower than the preset value, the condition is determined to be decelerating drive condition with clutch-on, and the fuel supply reduction control at the time of full supply resumption is performed to prevent the deterioration of the drive feeling at the time of fuel supply resumption during decelerating drive. In accordance with the present invention, the fuel-cut speed $N_1$ can be set up to be lower than in the prior art, and thus the fuel cut range can be extended to increase the advantage of fuel cut.

DESCRIPTION OF THE PREFERRED EMBODIMENTS

Figure 1:
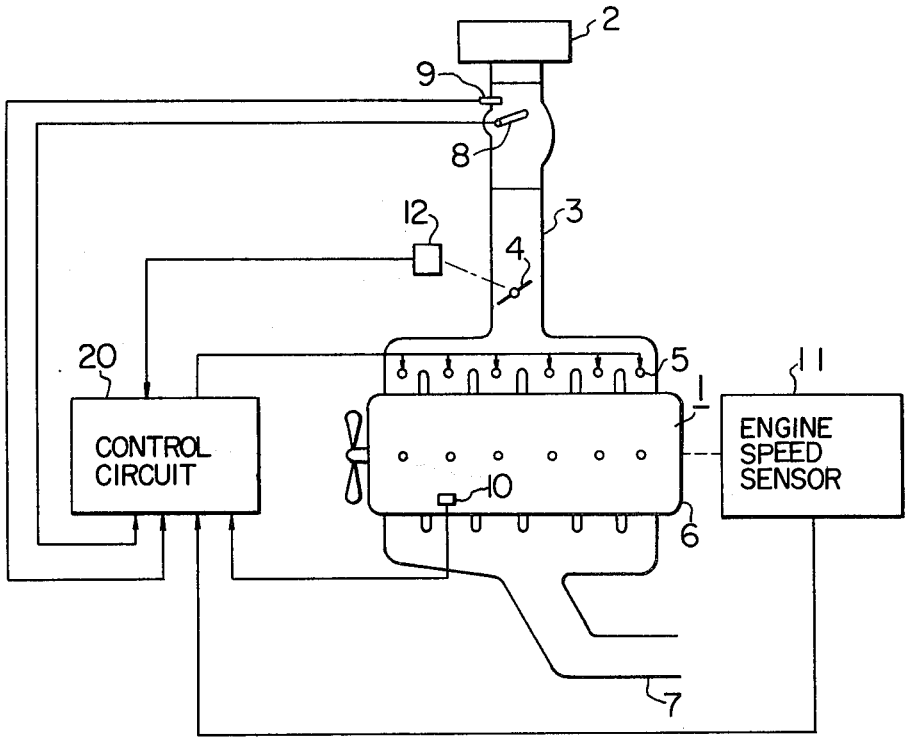
FIG. 1 shows the whole arrangement of an embodiment of the apparatus according to the invention.

FIG. 1 shows an embodiment of the invention. An engine 1 is a known 4-cycle spark ignition engine incorporated in an automobile, which takes in air for combustion via an air cleaner 2, an intake pipe 3 and a throttle valve 4. The output of a control circuit 20 causes electromagnetic injection valves 5 to open to supply fuel to the respective cylinders. The exhaust gas after combustion is discharged via an exhaust manifold 6, an exhaust pipe 7 and so on. In the intake pipe 3 a potentiometer-type intake air amount sensor 8 is provided for detecting the amount of air taken into the engine 1 and producing an analog voltage corresponding to the amount of the intake air, and also there is provided a thermister-type air temperature sensor 9 for detecting the temperature of the intake air and producing an analog voltage corresponding to the temperature of the intake air. In the engine 1 there is provided a thermister-type water temperature sensor 10 for detecting the temperature of cooling water and producing an analog voltage (analog detection signal) corresponding to the cooling water temperature. An engine speed sensor 11 is provided to detect the rotational speed of the crankshaft of the engine 1 and produce a pulse signal of the pulse period which corresponds to the engine speed. This engine speed sensor 11 may be, for example, an ignition coil of igniter, and the ignition pulse signal from the primary of the ignition coil may be used as a signal of engine speed. At the throttle valve 4 there is provided an idle switch 12 for detecting that the degree to which the throttle valve opens is less than a predetermined value, e.g., for detecting whether the throttle valve is entirely closed or not. Thus, the control circuit 20 is supplied with the detection signals from the respective sensors 8 to 12 and on the basis of those signals the control circuit 20 computes the amount of fuel to be injected. The resulting output from the control circuit 20 controls the time during which the fuel injection valves 5 are opening, thereby adjusting the amount of fuel to be injected.

Figure 2:
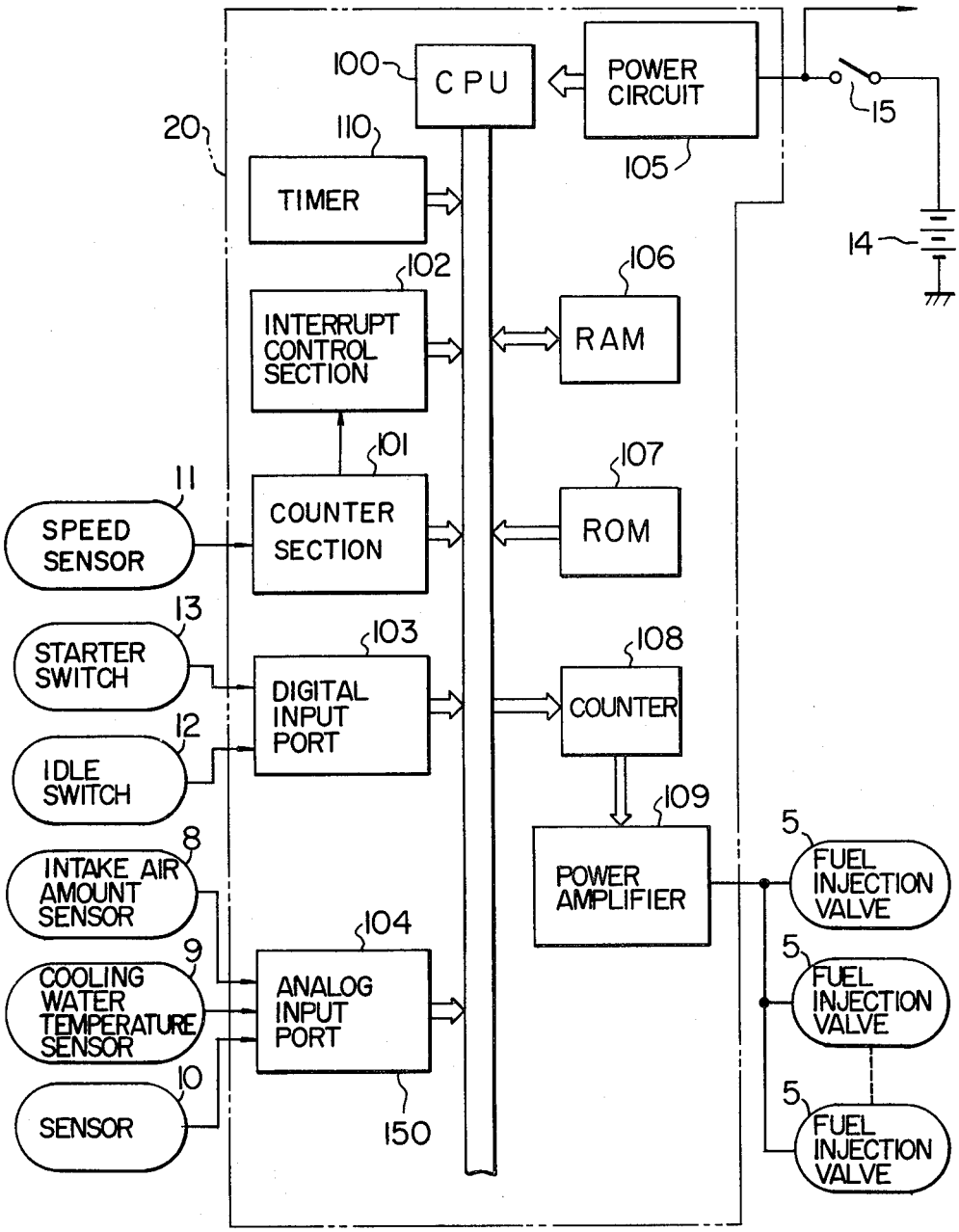
FIG. 2 is a block diagram of the control circuit in FIG. 1.

The control circuit or micro computer 20 will be described with reference to FIG. 2. Reference numeral 100 designates a processor (CPU) for computing the amount of fuel to be injected, and 101 a counter section for measuring the period of the signals from the engine speed sensor 11 to determine the engine speed. This counter section 101 supplies an interruption command signal to an interruption control section 102 in synchronism with the rotation of engine. When this signal is supplied, the interruption control section 102 produces an interruption signal and supplies it via a common bus 150 to the CPU 100. A digital input port 103 receives digital signals of starter signals etc. from a starter switch 13 which turns on and off the operation of a starter (not shown). An analog input port 104 has an analog multiplexer and an A/D (analog to digital) converter and thus serves to convert the signals from the intake air amount sensor 8 and cooling water temperature sensor 9 to digital values and supply them to the CPU 100 in sequence. The output information from the units 101, 102, 103 and 104 are supplied via the common bus 150 to the CPU 100. Reference numeral 105 designates a power circuit connected through a key switch 15 to a battery 14, 106 a random access memory (RAM) capable of reading and writing information, 107 a read-only memory (ROM) in which programs and various constants are stored, and 108 a fuel injection time control counter including a register. This counter 108 is constituted of a down counter and converts the digital signal indicative of the valve-opening time for which the fuel injection valve 5 opens, or the amount of fuel to be injected, which is computed by the CPU 100, to a pulse signal of the duration corresponding to the actual valve opening time of the fuel injection valve 5. Reference numeral 109 designates a power amplifying section for driving the valve 5, and 110 a timer for measuring lapse of time and supplying an information of the measured time to the CPU 100. The engine speed counter 101 measures the speed of the engine once per a revolution of engine by means of the output of the sensor 11 and upon completion of each measurement, supplies an interruption command signal to the interruption control section 102. The interruption control section 102 is responsive to the command signal to generate an interruption signal thereby causing the CPU 100 to execute an interruption processing routine for computation of the amount of fuel to be injected.

Figure 3:
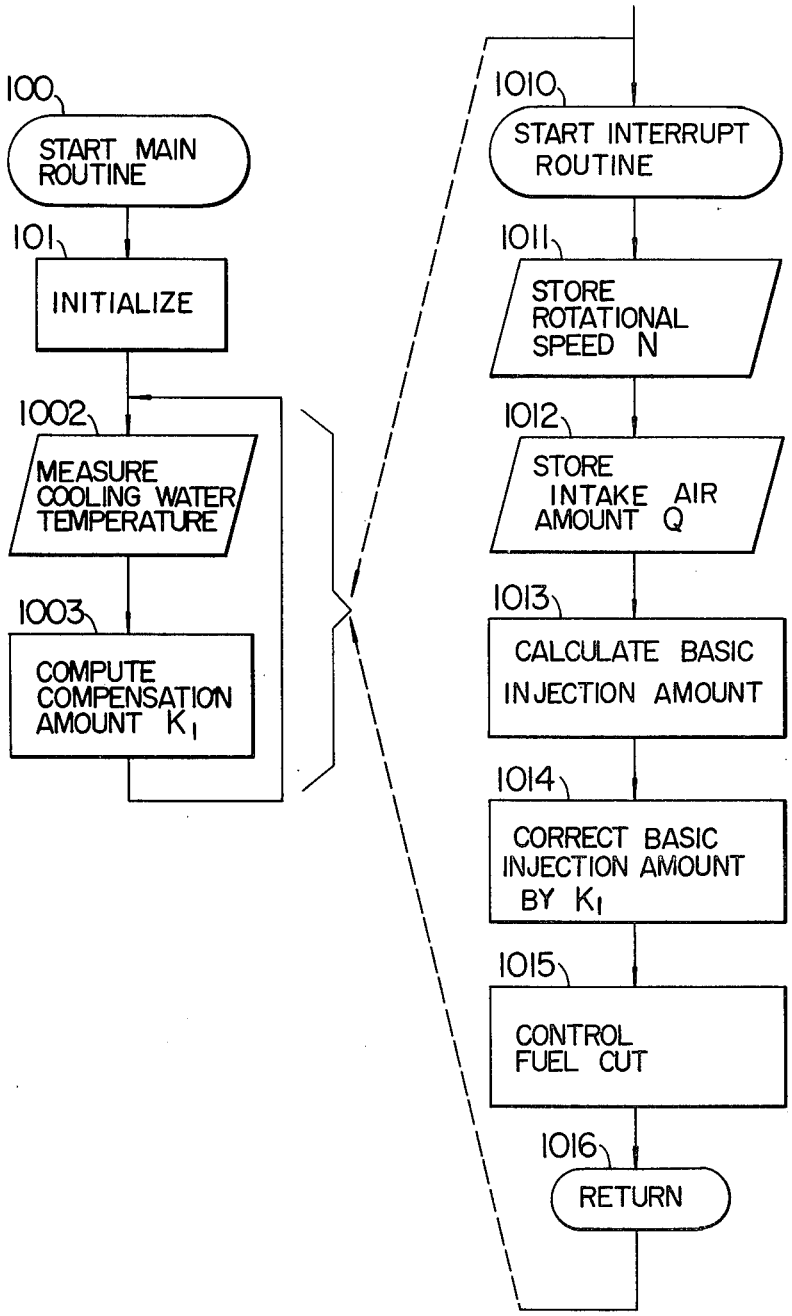
FIG. 3 is a flowchart of the operation of the microprocessor in FIG. 2.

FIG. 3 is a flowchart of the operation of the CPU 100. The function of the CPU 100 and the operation of whole arrangements will be described hereinafter with reference to the flowchart of FIG. 3. When the engine 1 is started by turning on the switches 15 and 13, the main routine for arithmetic processing starts at a first step 1000. Then, at step 1001, initialization is performed, and at step 1002, a digital value corresponding to the cooling water temperature from the analog input port 104 is read in. At step 1003, a fuel correction amount $K_1$ is calculated on the basis of the results of reading at step 1002 and is stored in the RAM 106. When the step 1003 is completed, the program returns to the step 1002. Usually, the CPU 100 repeatedly executes the main routine of steps 1002 to 1003 in FIG. 3 in accordance with the control program. When the interruption signal is inputted from the interruption control section 102, the CPU 100 immediately interrups its process even during the processing of the main routine and goes to the interruption processing routine at step 1010. At step 1011, the CPU 100 receives a signal indicative of the engine speed N of engine from the engine speed counter 101 and then at step 1012, the CPU 100 receives a signal representive of the amount Q of intake air flow from the analog input port 104. At step 1013, the CPU 100 computes a basic amount of fuel to be injected, which is determined by the engine speed N and the amount Q of intake air (i.e., the injection time t during which the fuel injection valves 5 are opened). The time t is determined by $t=F\times(Q/N)$ (F: constant). At step 1014, the CPU reads the correction amount $K_1$ for fuel injection determined in the main routine from the RAM 106 and calculates the connection of the amount of injection (injection time) which decides the air-fuel ratio. The program is advanced to step 1015 of fuel cutting control and then returns to the main routine through step 1016.

Before describing the fuel cutting control at step 1015 which control is a feature of this invention, it will be described as to a method for detecting the operating condition of engine by determining whether the decelerating speed of engine speed at the time of deceleration is larger than a predetermined value or not.

Figure 4:
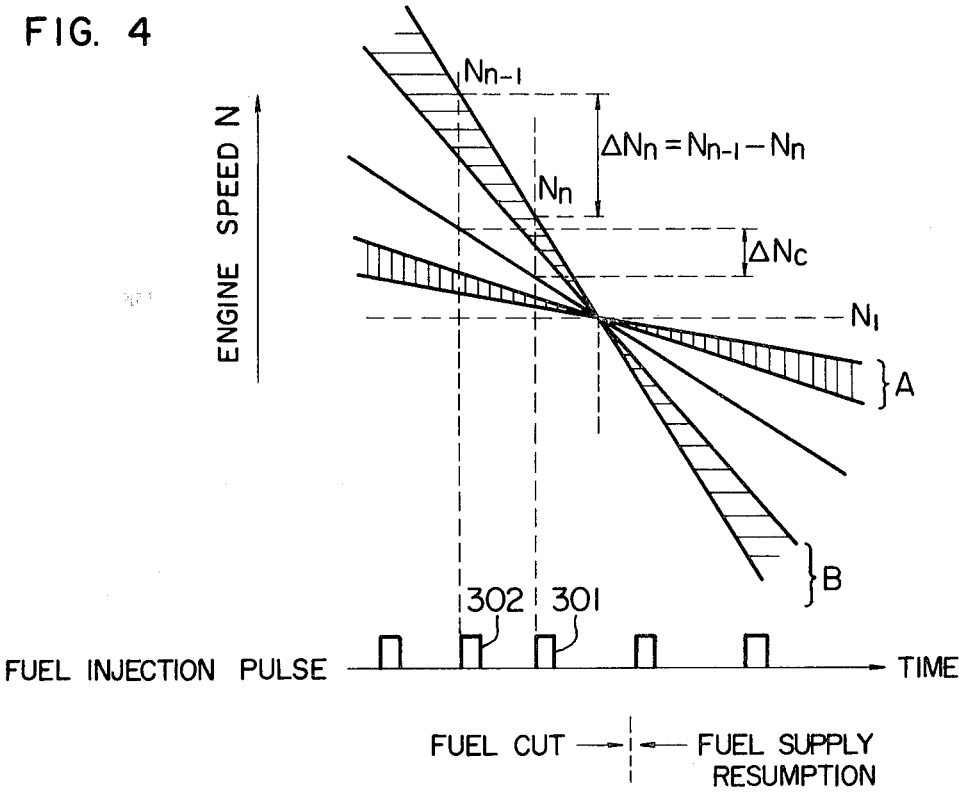
FIG. 4 is an explanatory diagram for the method of detecting the driving condition from the decelerating speed of engine.

FIG. 4 shows the change of the engine speed with time when decelerating the engine. When the engine is decelerated from the fuel cut state and the engine speed N has reached a preset value $N_1$, fuel injection resumption is made. The decelerating speed at resumption of fuel injection (the decreased engine speed) $\Delta N_n$ is expressed by $$\Delta N_n = N_{n-1} - N_n$$

where $N_n$ represents the engine speed at a point synchronized with the time of a basic injection pulse duration output (output 301 at step 1013) just before the engine speed has become $N_1$ or below and $N_{n-1}$ is the engine speed at a point synchronized with the time of a pulse 302 just before the pulse 301. In FIG. 4, the hatched areas A represent the reduction of the engine speed when running while decelerating with clutch on, and the hatched areas B represent that when running while decelerating with clutch off or when racing. The decelerating speed $\Delta N_n$ at the time of racing (or at the time of running while decelerating with clutch off) and that at the time of running while decelerating with clutch on differ greatly from each other By determining whether the $\Delta N$ is larger than a preset decelerating speed $\Delta N_c$ which is preset to be about middle of the above two $\Delta N_n$s, it is possible to detect whether the engine is in the racing state or decelerating state with clutch on. The step 15 will be described with reference to the flowchart of FIG. 5 on the basis of the above thought.

Figure 6:
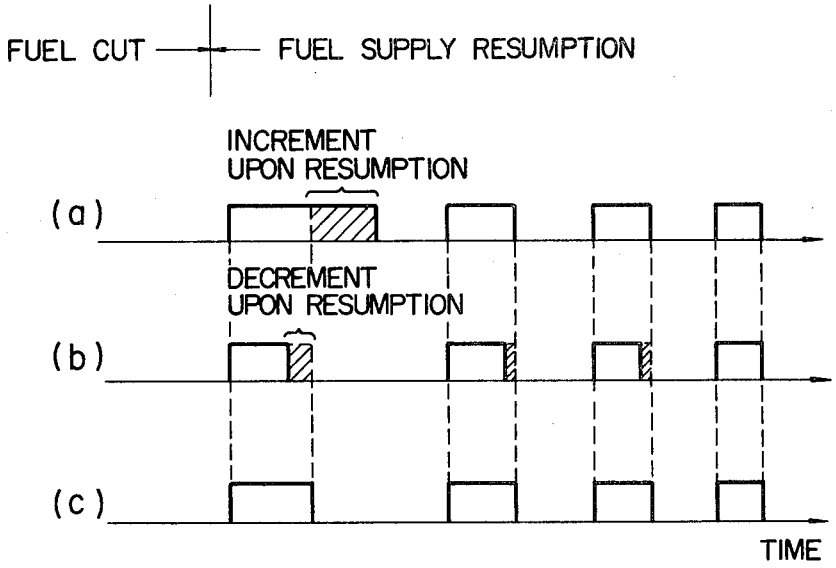
FIG. 6(*a-c*) shows pulses to be applied to the electromagnetic injection valve, which are useful for explaining the operation of the embodiment.
Figure 5:
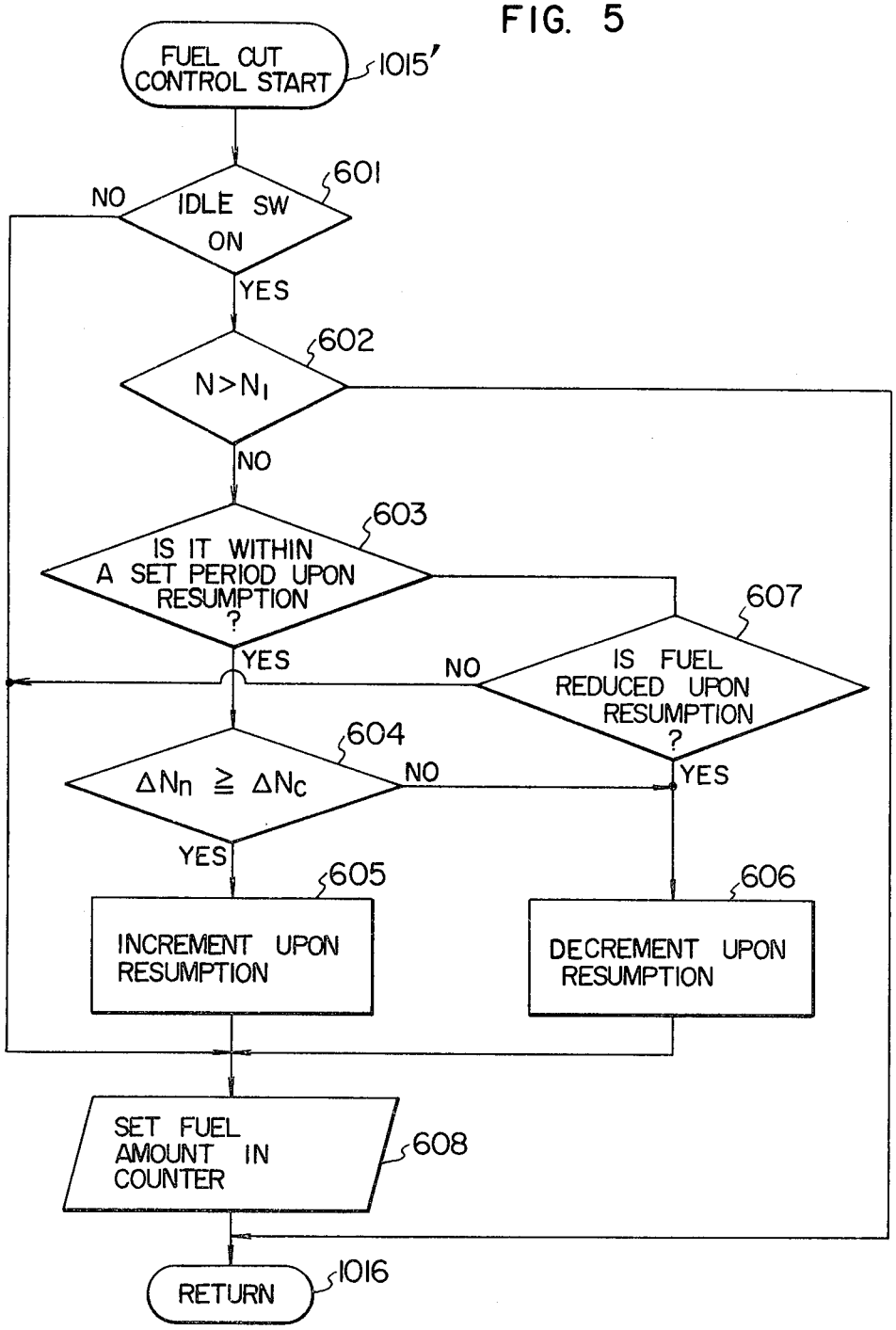
FIG. 5 is a flowchart of the fuel supply cut control steps in the flowchart of FIG. 3.

The step 1015 starts at a fuel cut control step 1015' in FIG. 5, and at step 601 decision is made of whether the idle switch 12 is on or not. If it is off, the program goes to step 608 where the amount of fuel to be injected is set in the counter. If the idle switch 12 is on, the program goes to step 602 where decision is made of whether the engine speed is larger than the fuel-cut speed or not. If it is larger than that, the program jumps over step 608 to step 1016 where fuel injection is stopped. If it is smaller than the fuel-cut speed, the program goes to step 603, where decision is made of whether the output pulse width at step 1013 is within a period of time for fuel injection resumption or not. If it is within the period, the program goes to step 604 where the decelerating speed of engine at the time of fuel injection resumption at every revolution is determined. When the result is that the decelerating speed $\Delta N$ is equal to or larger than the preset decelerating speed $\Delta N_c$ ($\Delta N \geqq \Delta N_c$), it is decided that the engine is in the racing condition (including the decelerating condition with clutch off) and the program goes to step 605 where fuel injection resumes and at the same time fuel supply is increased to prevent engine stall. If $\Delta N < \Delta N_c$, it is decided that the engine is in the so-called normal decelerating condition with clutch on, and the program goes to step 606 where the fuel supply reducing control at the time of fuel supply resumption is performed to prevent the deterioration of drive feeling at the time of fuel supply resumption. If the clutch is turned off within the preset period of fuel supply resumption, the decision result at step 604 becomes $\Delta N \geqq \Delta N_c$, thus the fuel amount reduction at the time of fuel supply resumption is stopped, and the fuel amount increase at the time of fuel supply resumption is performed and thereby the engine stall is prevented. When the decision result at step 603 is that it is beyond the fuel supply resumption set period, the program goes to step 607 where decision is made of whether fuel amount decrease at the time of fuel supply resumption is being performed or not. If the fuel amount decrease is being made, the decrease is continued. If the decrease is not being made, the program goes to step 608. FIG. 6 shows such control operations on the basis of the pulse width siganl applied to the fuel injection valve 5 at the time of fuel supply resumption. When $\Delta N_n \geqq \Delta N_c$, at the same time as the fuel supply resumes a pulse with a longer pulse width than the pulse width (FIG. 6*c*) determined by the normal calculation is applied, as shown in FIG. 6*a*. When $\Delta N_n < \Delta N_c$, at the same time as the fuel supply resumes a pulse with a shorter pulse width than the pulse width (FIG. 6*c*) determined by the normal calculation is applied as shown in FIG. 6*b*. In both cases, the increased and decreased pulse widths are gradually restored to the original normal pulse width as shown in FIGS. 6*a* and 6*b*.

We claim:

1. An electronic control type fuel injection system comprising:

sensor means, including an engine speed sensor, for detecting states of an engine;

computer means for reading the detected output signals from said sensor means and computing the amount of fuel to be injected;

converter means for converting a signal indicative of the amount of fuel to be injected from the computer means to a pulse signal having a pulse width corresponding to the time during which fuel is to be injected; and injection valve means which open in accordance with said pulse signal to inject fuel to engine;

said computer means stopping fuel injection when the engine speed is reduced and is higher than a predetermined cut speed, and then: (1) when the change in speed of the engine is smaller than a predetermined value, at the time of fuel supply resumption, a pulse signal of a narrower width than a normal pulse width occurring in fuel injection had not been stopped is first applied to the injection valve means, and thereafter the widths of the pulses subsequently applied are gradually increased back to the normal pulse width, and (2) when the change in speed of the engine is larger than said predetermined value, a pulse signal of a wider width than said narrower width is applied to said injection valve means at the time of fuel supply resumption.

2. A system according to claim 1, wherein said computer means operate such that when the change in engine speed is larger than said predetermined value, a pulse signal of a wider width than said normal pulse width is first applied to said injection valve means at the time of fuel supply resumption.

3. A system according to claim 1, wherein said computer means operates such that: (1) when an idle switch which is responsive to opening degree of a throttle valve of the engine is on and the engine speed is larger than then predetermined cut speed, fuel injection is stopped, (2) when the idle switch is on, the engine speed is smaller than said fuel supply cut engine speed and a previous fuel supply resumption occurred within a preset period, when: (a) said change in engine speed is smaller than a predetermined speed value, a pulse signal of a narrower width than said normal pulse width is first applied to the injection valve means upon fuel supply resumption, and the widths of pulses applied subsequently are gradually increased, and (b) the change in engine speed is higher than the predetermined speed value, a pulse signal of a wider width than said normal pulse width is applied to the injection valve means at the time of fuel supply resumption, and (3) when the idle switch is on, the engine speed is smaller than said fuel supply cut engine speed, and the fuel supply is presently reduced after a fuel supply resumption, the fuel supply reduction is continued even after the preset period from the fuel supply resumption.

4. A system according to claim 1, 2 or 3, wherein said computer means includes a microcomputer.

* * * * *